United States Patent [19]

Richardson

[11] 4,365,810

[45] Dec. 28, 1982

[54] GAMING BOARD

[75] Inventor: John Richardson, San Diego, Calif.

[73] Assignee: Selectro-Vision, Ltd., San Diego, Calif.

[21] Appl. No.: 79,807

[22] Filed: Sep. 28, 1979

[51] Int. Cl.[3] ..... A63F 3/06

[52] U.S. Cl. ..... 273/237; 273/269

[58] Field of Search ..... 340/323 R; 235/926 A; 364/410, 411; 273/237, 138 A, 16 E, 1 E, 269; 434/200, 201

[56] References Cited

U.S. PATENT DOCUMENTS

| | | | |
|---|---|---|---|
| 3,671,041 | 6/1972 | Taylor et al. . | |
| 3,711,963 | 1/1973 | Hunnicutt et al. | 434/335 |
| 3,731,935 | 5/1973 | Moore, Jr. . | |
| 3,787,988 | 1/1974 | Nakajima et al. | 434/201 |
| 3,909,001 | 9/1975 | Feldhausen . | |
| 3,984,107 | 10/1976 | Nelson . | |
| 4,051,608 | 10/1977 | Duncan | 434/201 |
| 4,080,596 | 3/1978 | Keck et al. | 273/237 |
| 4,082,285 | 4/1978 | Bathurst | 273/237 |
| 4,084,823 | 4/1978 | Haggedal . | |
| 4,089,124 | 5/1978 | Burtis et al. | 434/201 |
| 4,165,878 | 8/1979 | Frain . | |
| 4,222,571 | 9/1980 | Molat | 273/237 |
| 4,240,638 | 12/1980 | Morrison et al. | 273/138 A |

*Primary Examiner*—Vance Y. Hum
*Assistant Examiner*—Leo P. Picard
*Attorney, Agent, or Firm*—Albert A. H. Koch

[57] ABSTRACT

A gaming board for recording numbers, letters and/or other symbols which are selected at random during the game by the game operator is disclosed; the gaming board displays a symbolic array which has been predetermined and inputted by the game player prior to the start of the game and further provides for the display of sub-arrays of a specified shape or character which, if completed as a result of the selection of random numbers which correspond to the predetermined numbers prior to or simultaneous with another player completing the sub-array, wins the game; a winning combination indicator means is also disclosed as part of the gaming board. A safety device to prevent variation of the predetermined/inputted array during the game and other features are also disclosed.

13 Claims, 10 Drawing Figures

GAMING BOARD

The present invention relates generally to an improved gaming board primarily for use in games such as BINGO, and more specifically to a gaming board which gives the player the flexibility of inputting his own selection of numbers and further provides the player with an indication of what numbers must be randomly drawn by the game operator to yield a winning board. The board also indicates to the player when that winning combination of player inputted and randomly drawn numbers in the desired shape occurs.

In BINGO and similar games of chance the basic elements of the game are a gaming board and a random number generating device. The gaming board can be a square array of numbers, usually a 5×5 array, with the centermost location being blank or termed "free." The game is played generally with either 75 or 90 numbers, and each column in the array is limited to only one-fifth of the numbers; e.g., the first column numbers would be taken from the group 1 to 15 in the event 75 numbers being selected from, 1 to 18 if it is 90; the second column would be taken from the group 16 to 30 or 19 to 36, and so on. Further, duplicate numbers cannot and should not appear on the gaming board. When the game is being played, the game operator specifies a shape or pattern to be formed on the gaming board by the randomly drawn numbers and then proceeds to call numbers at random between 1 and 75 or 90, whichever is appropriate. If a number called coincides with one on the player's board, the player then marks the number in some fashion on his board. The object of the game is to be the first player to have the randomly called numbers coincide with the preselected numbers on the player's board so as to form the specified shape or pattern. The specified shape or pattern may be an "X," "T," "L," a diagonal line, any five numbers horizontally or vertically, and so on.

Several games of between about twelve and eighteen constitute a BINGO program which is played during the course of an evening of several hours. The games are played consecutively and essentially without any major interruption except for possible intermissions.

These games have long been played with boards which have a fixed printed numerical array. Players would select from a large number of boards and therefore be unable to create and play with an array of their own choosing and determination. While some games have been played with blank paper boards that are filled in by the player writing in the number desired, the cards are limited in size, can essentially only be used once since the player marks out the random number called with an ink dauber or like means, and result in an inefficiency of operation for playing consecutive games on a minimum interruption basis. This inefficiency affects both the game operator, who must find and check a copy of the marked paper board which has been collected to avoid an unauthorized change in the numbers once the game has started, and the player, who must prepare a new board prior to each game; both of these require time and detract from a desired even, and essentially uninterrupted, flow of a successful BINGO program. It is mainly for these reasons that the blank board approach has been used only for a single game and then generally the first one of the BINGO program. Another important factor is to provide a board which cannot be changed without the knowledge of the game operator and which provides an indication that it was acquired for use in the particular program being conducted and can be checked quickly in the event it displays a winning combination. Further, because generally each game during a normal BINGO program varies as far as the shape which the winning array must take, it is desirable for the player to have the ability to have the shape of the winning array promptly displayed on his board and, further, to be provided with an automatic indication of when that array has been achieved.

Accordingly, it is an object of the present invention to provide a gaming board for use in games akin to BINGO which gives the player the flexibility of being able to promptly input his own predetermined array of symbols with which to play during all or a substantial part of a BINGO program.

Another object of the present invention is to provide such a board which has a built in safeguard which protects the player from inputting numbers which are out of limit for the location in the array of which are duplications.

Another object of the present invention is to provide such a board which secures the player's inputted array so that it cannot be modified or otherwise changed until the operator of the program permits the change.

Another object is to provide such a board which generally displays the shape of the array to be formed from the randomly called numbers.

Another object is to provide such a board which signals the player when a winning array has been achieved on his board.

These and other objects and advantages of the present invention will become apparent upon reading the following detailed description, will referring to the attached drawings, in which.

FIGS. *3a*, *3b*, *3c* and *3d* together comprise a flow diagram illustrating the basic operation of the present invention.

FIG. *4a* and FIG. *4b* together comprise an electrical schematic diagram of the present invention which utilizes light emitting diodes as the display means.

Figure 5:
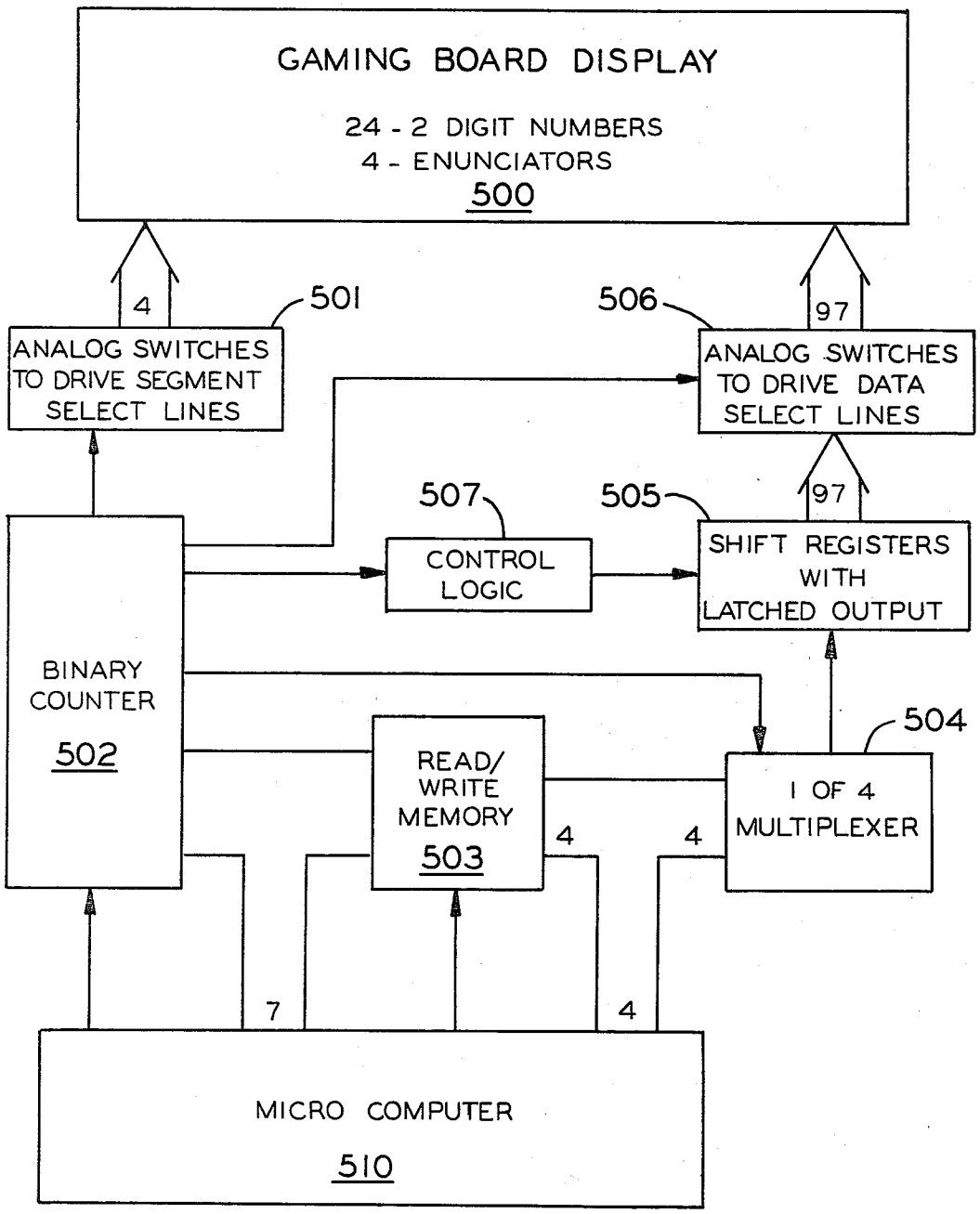

FIG. 5 is a block diagram illustrating the timing and control components and circuitry of the present invention which utilizes liquid crystal displays as the display means.

The gaming board may be used to display numbers, alphabetic letters, or any other symbols which can be simulated using the display means. The present invention herein described utilizes numbers but it is not intended to be limited to such. The specific embodiment shown herein provides a gaming board having a 5×5 array of display means; the shape or size of the array which the present invention may take is not intended to be limited to such. While the primary embodiment depicted makes use of light emitting diodes (LEDs) as the display means, other devices such as liquid crystal displays (LCDs) or other electronic display devices can be substituted.

Figure 1:
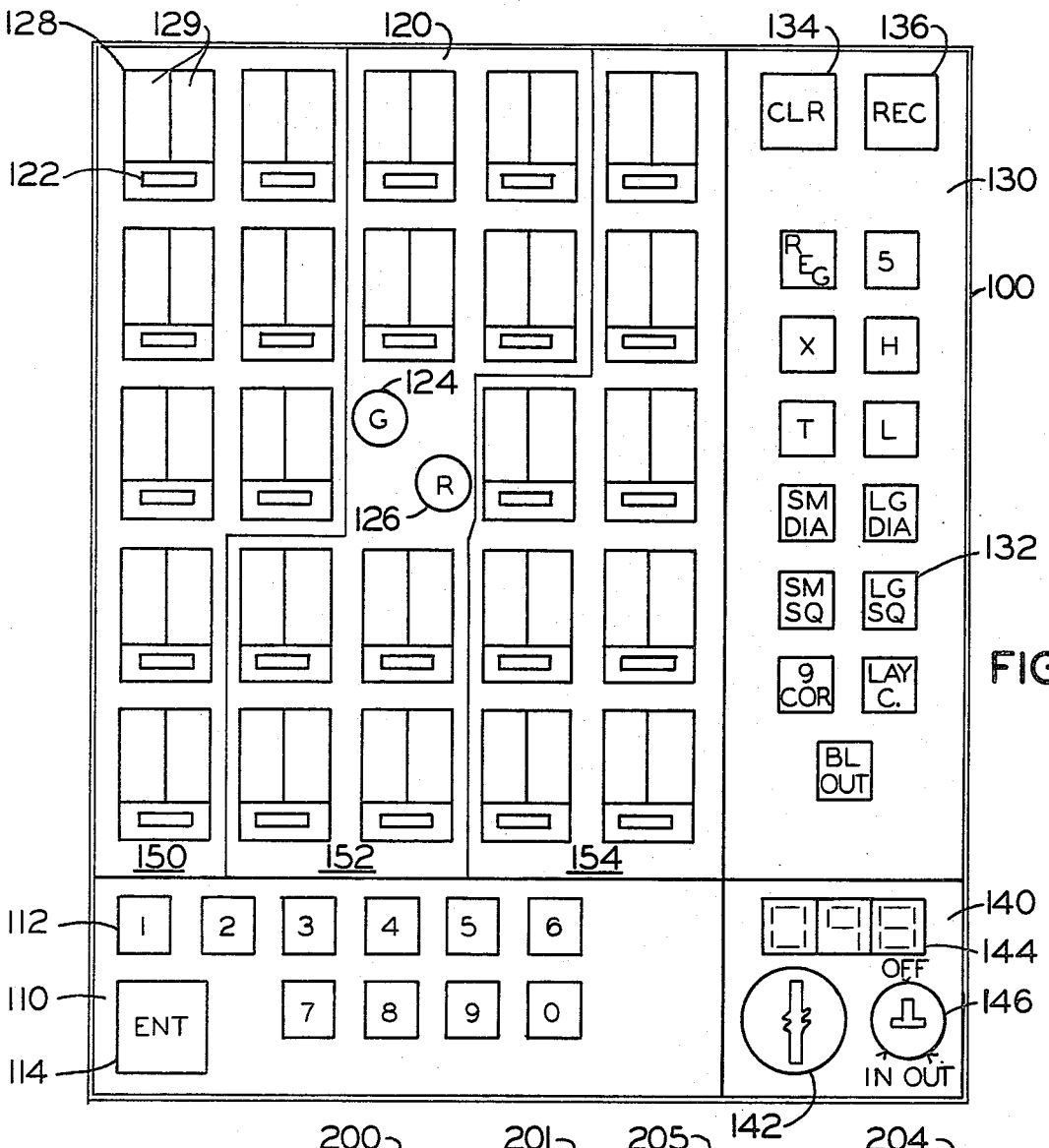
FIG. 1 is a plan view of a gaming board embodying the present invention.

FIG. 1 depicts a plan view of the overall gaming board. The gaming board 100 is essentially divided into three main parts: first, the number input part 110; second, the display part 120; and third, the game selection part 130. A fourth part of the gaming board is the security part of the board 140 and contains a key operated reset-on/off switch 142, a load mode timer display 144, and a program check means switch 146. The board operates in two modes—a load mode and a play mode. During the load mode the numerical array selected by the player is inputted into the display part 120 one number at a time by depressing the appropriate keys in the number input part 110. When all the numbers have been inputted, completing the array, the board automatically shifts into the play mode. The game operator may limit the period of time within which a player can input his array by setting a load mode timer which automatically shuts off the gaming board in the event the array has not been completed within the period of time set. A visual display of the time remaining 144 can also be provided. During the play mode the player first inputs the type of game which is to be played using the game selection part 130; then, as each randomly drawn number is called, if the number drawn appears on the player's gaming board he may indicate that the number has been called by depressing the blanking switches 122 associated with the location on the board. When the game shape has been achieved on the board, the green light 124 lights up as does the winning array while the other numbers are blanked, thereby clearly indicating immediately to the player that he has won. The number input part 110 is operative only in the load mode, while the game selection part 130 is operative only in the play mode. The display part 120 is essentially operative in both modes—the exception relates to the blanking switches 122 as described later. The security part 140 is not used by the game player other than to keep track of the time remaining within which to complete the loading operation through viewing the load mode timer display 144; the other switches, a reset-on/off switch 142 and a code display switch 146, are controlled by the game operator and are described later.

The board is activated or reset by a key-operated reset-on/off switch 142. Simultaneously a load mode timer is also activated, a digital readout 144 indicates to the player the time remaining for loading numbers before load mode shutoff.

The number input part of the gaming board 110 comprises a keyboard of ten number selection keys 112, which cover the digits 0 to 9 inclusively, and an entry key 114. In the embodiment described, the numbers are loaded in a predetermined sequence, first a columnar fashion, i.e., from top to bottom and then from left to right. The loading sequence may also be selected by the player such that he may address the location to be loaded by typing in the location number and then the number to be loaded. The number to be loaded into the array is typed in and appears on the display part 120 at the location being loaded; when the player is satisfied with his selection and it meets the limitations of the game noted earlier, i.e., it is not a duplicate and is within the range allowed for the location being loaded, the entry key 114 is depressed and the number is fixed in the gaming board's memory and the next display location is then ready to be loaded.

The display part of the gaming board 120 comprises twenty-four symbol display locations 128, each location contains two digital displays 129 which form the display means and an array-symbol switching system 122 for blanking out the number in that location during play; in the alternative, the switches when depressed may cause a dimming or brightening of the number or otherwise visually distinguish that display location from ones at which the switches have not been depressed. In the center of the display part of the gaming board 120 are green 124 and red 126 lights. The digital readout display 129 is an LED device and is composed of seven diodes which, depending on which segments or diodes are lit, can form any integer from 0 to 9. The array-symbol switch means 122 is a normally open electronic momentary switch. The player depresses the array-symbol switch 122 to shut off the particular number displayed in symbol display location 128 associated with that switch. The centrally located green and red lights 124 and 126 indicate to the player during the load mode whether the number in the display location for loading meets all conditions; during the play mode, the green light 124 operates as a winning/pattern match indicator.

The game selection part of the game board 130 comprises thirteen game selection keys 132, a clear key 134, and a recall key 136, generally in the form of a keyboard. By depressing a pattern selection key 132, the player inputs the particular pattern specified by the game operator which the randomly called numbers must form on the board to provide a winning array. The clear key 134 will relight the numbers which have been switched off during the prior game. The game pattern remains the same after the clear key has been depressed and is changed by depressing another game pattern key. The recall key 136 temporarily, so long as the key is depressed, relights all the numbers on the board enabling the player to see what numbers have been called and where they were on the board.

Figure 2:
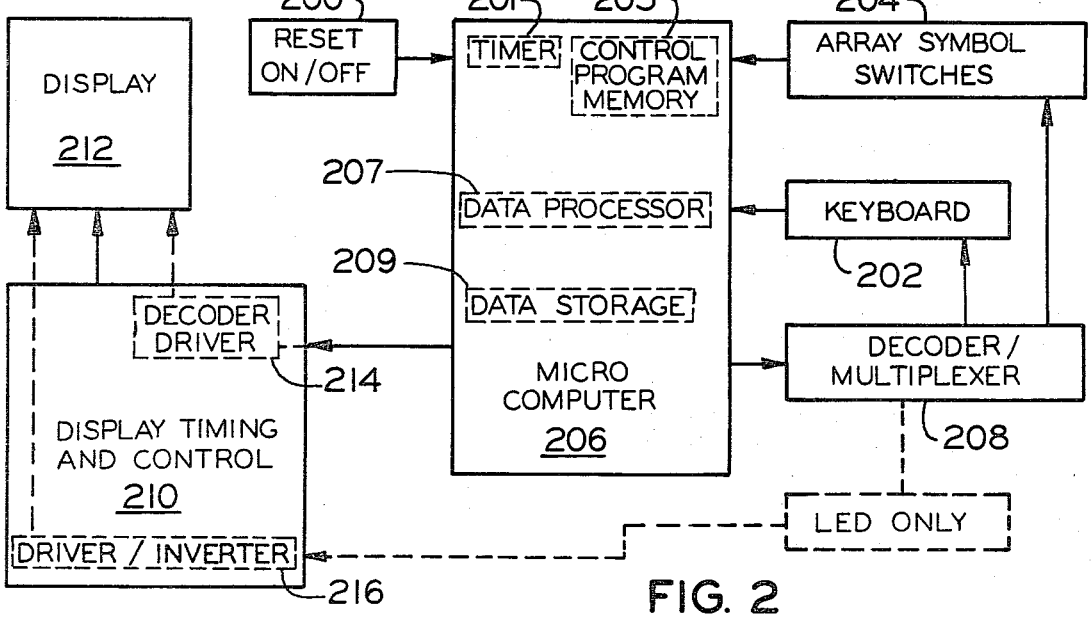
FIG. 2 is a simplified block diagram illustrating the general components and circuitry of a gaming board embodying the present invention.

FIG. 2 provides a simplified block diagram of the essential components and circuitry of a gaming board embodying the present invention. The board is activated through a reset-on/off switch 200. Start of operation also enables the load mode timer. If the player has not completed loading the array within the time alloted by the game operator, the board is automatically deactivated and must be reset by the game operator. Both the load mode timer and automatic shut-off means 201 are associated with and form a part of the microcomputer 206.

Player input signals emanate from either keyboard 202 or array-symbol switches 204. Keyboard 202 in essence corresponds to the number input part 110 and game selection part 130 of the gaming board shown in FIG. 1. These signals are fed into a microcomputer 206 which contains the program which controls the operation of the gaming board. The computer comprises a nonvolatile memory 205 into which the control program is written, a data processor 207 and data storage capabilities 209. The computer 206 in turn generates output control signals to a decoder/multiplexing device 208 and the display timing and control system 210. The decoder/multiplexer 208 provides a continuous scanning signal to the keyboard 202 and the array-symbol switches 204 thereby enabling the computer 206 to decode the subsequent signals so as to be able to determine which key or switch has been depressed. The above multiplexing operation is utilized in gaming boards employing either LED or LCD digital displays. The circuitry and components which drive and otherwise provide the necessary input to the displays is, however, different for the LED and LCD devices. Generally speaking, however, a display timing/control system 210 is required for both LCD and LED devices which provides the necessary signals to enable the display 212. The display 212 in essence corresponds to a plurality of symbol display means 129 shown in FIG. 1. The dashed lines in FIG. 2 depict the basic components and circuitry required for LED display timing and control. For an LED digital a decoder/driver 214 and a driver-/inverter 216 are required. The computer 206 provides the necessary signals to the decoder/driver 214 directly while the decoder/multiplexer 208 provides the signal to the driver/inverter 216. Signals from the decoder/-driver 214 and driver/inverter 216 in turn provide the information required for the display 212 to function properly. The output signal from the driver/inverter 216 enables a given digit while the output signal from the decoder/driver 214 enables the individual segment of an LED display to display the desired digit. A more detailed schematic for an LCD digital display is shown in FIG. 5 and is described subsequently.

Figure 3A:
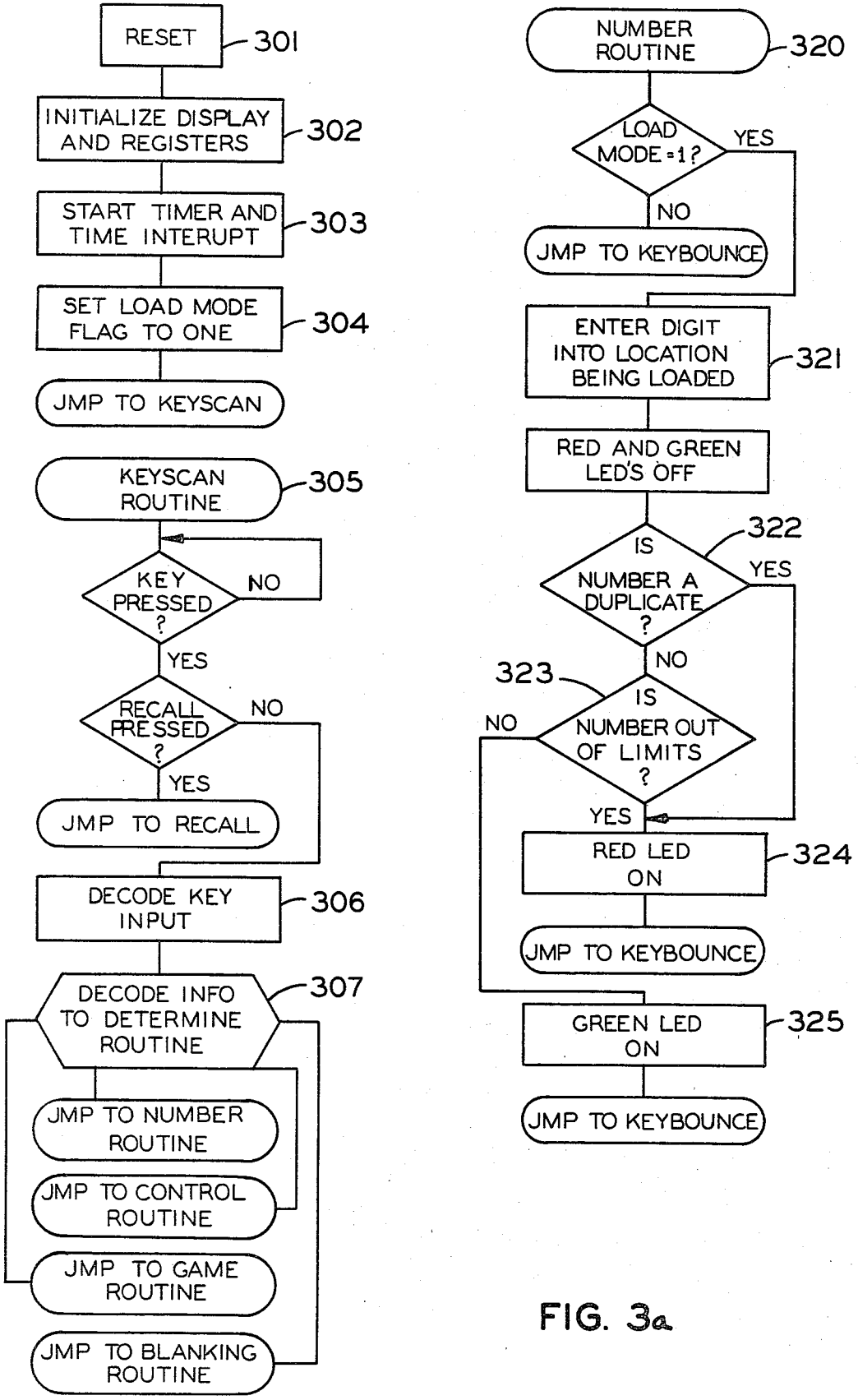

The basic operation behind the present invention is depicted in FIGS. 3*a*, 3*b*, 3*c*, and 3*d*, which provide a flow diagram of the control program 205 contained in the microcomputer 206 shown in FIG. 2. As noted earlier, the gaming board has two operational modes, a load mode and a play mode. The internal software program which controls the operation of the computer 206 has an address termed the load mode flag. If this is set to one, the gaming board operates in the load mode; if it is set to zero, the gaming board operates in the play mode. There are essentially nine routines which control the operation of the present invention in these two modes. Some of the routines operate only in the play mode, others in both modes, and one only in the load mode. As shown in FIG. 3*a*, once the board has been set into operation 301, all displays and location registers are activated and set to zero 302, the timer is implemented 303 which provides the player with a limited period of time in which to load his array and which also enables the time interrupt routine 350, and the load mode flag is set to one 304. Once a key or switch has been depressed, as indicated by the keyscan routine 305, the computer's data processor decodes the input information 306 and then determines which of the four main routines is to be entered 307 and sends it to the appropriate routine. Briefly, the nine routines and their functions are as follows:

The number routine 320, which is operative only in the load mode, loads a particular symbol storage location with the number punched into the keyboard 321 and then checks to determine if that number is not an improper-symbol, that it is within the appropriate numerical limits for the given column 322, and that it is not a duplicate of a previously inputted number 323; the green light 124 in FIG. 1 is then lit if both these checks are positive 325; the red light 126 in FIG. 1 is lit if either is negative 324.

Figure 3B:
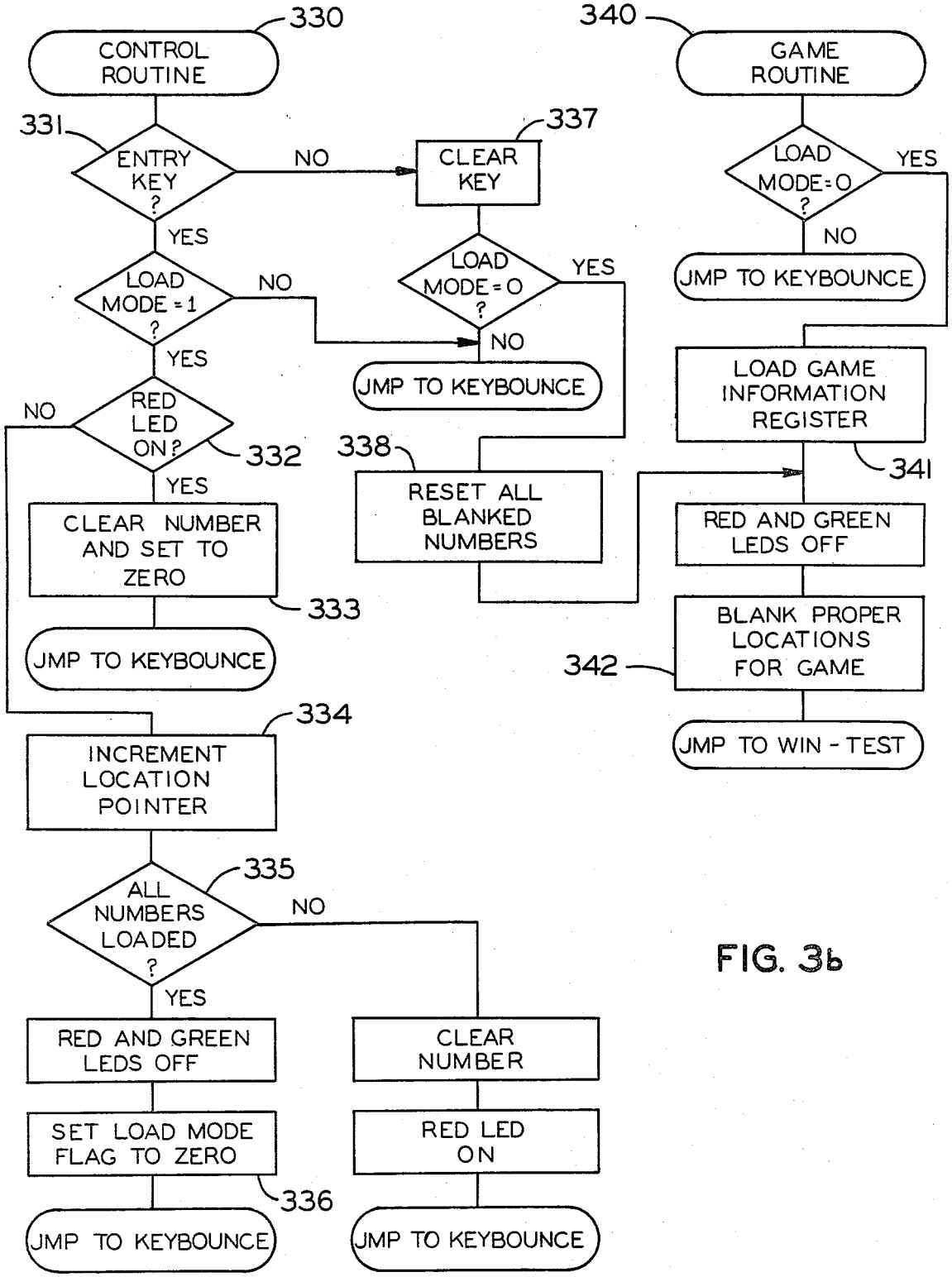
Figure 3C:
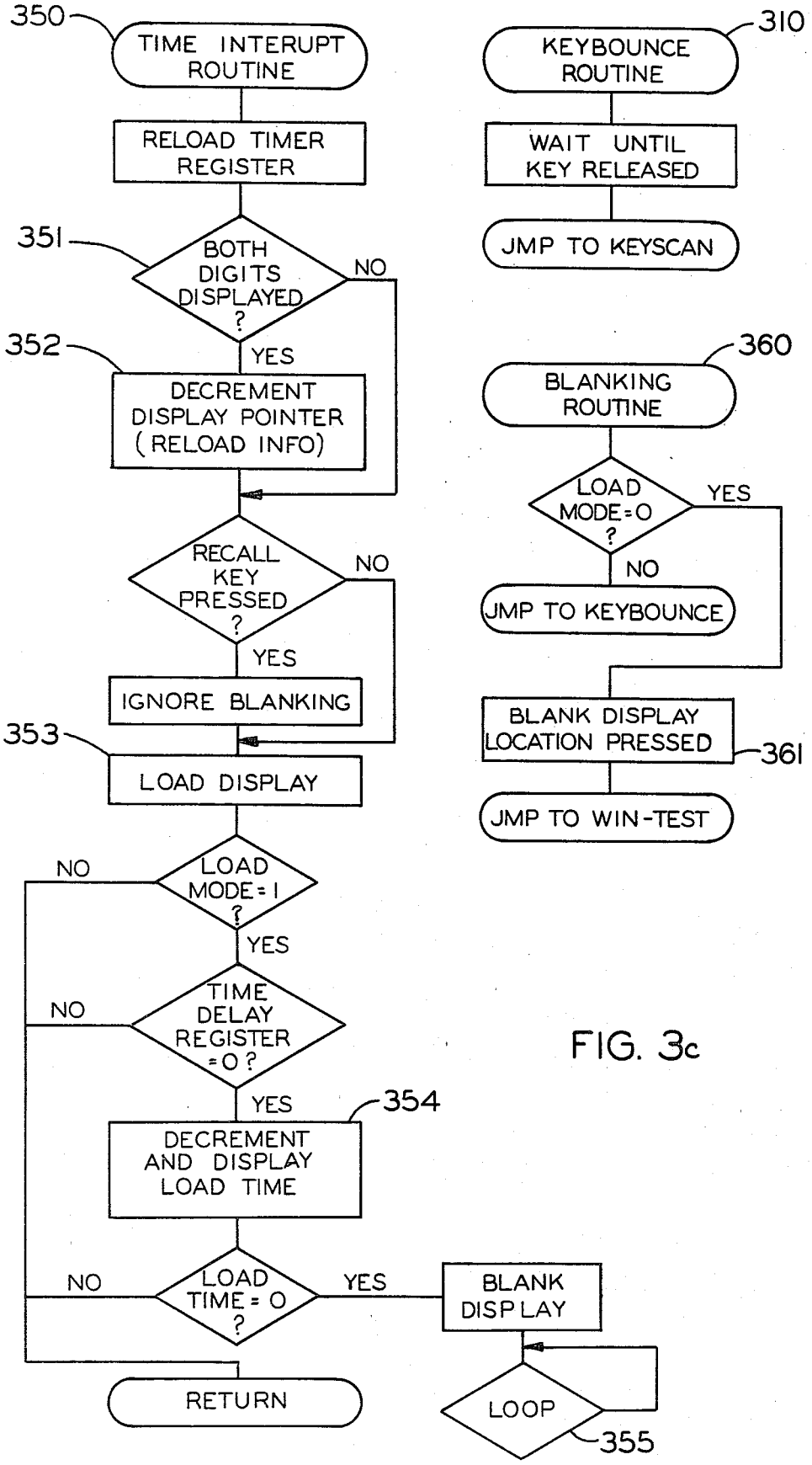

The keyscan, keybounce, time interrupt and control routines operate in both the load and play modes. The keyscan routine 305 shown in FIG. 3*a* is a high level check routine to determine if a key or switch has been depressed. The keybounce routine 310 shown in FIG. 3*c* is a software key debounce routine which determines if a depressed key or switch has been released for a given period of time by a low level check. The time interrupt routine 350 in FIG. 3*c* is an automatic routine which is self-activated at set time intervals. e.g., 1.1 ms, and renews information to certain display locations so as to provide a display which is visually continuous. To avoid flickering of the displays and to achieve a visually continuous display while minimizing the number of circuits a time division multiplexing scheme is utilized wherein the display part of game board 120 in FIG. 1 has been divided into three parts, the first eight display locations 150, the second eight display locations 152 and the third eight display locations 154. The time interrupt routine 350 in FIG. 3*c* causes information to be fed simultaneously to one display location in each of these parts for 1.1 ms; if both digits have been displayed 351, it then decrements each of the display location pointers 352 and feeds information to them 353; this operation continues automatically so long as the gaming board is activated. Further, if the board is in the load mode, this routine also decrements the count-down time display 354, thereby indicating to the player the time remaining within which to load his numerical array. If time runs out before the array has been inputted, this routine effectively shuts off the entire board by causing it to loop 355, thereby blanking the display and preventing further operation of the gaming board unless the board is reset. As an alternate to blanking, the numbers which have been loaded at the time of looping can be retained in the display and the reset operation just provide additional time without initializing the display. In the load mode the control routine 330 in FIG. 3*b* is activated by the entry key 331; the routine checks the output of the number routine 332; if the number routine output indicates that the light is red, the control routine sets the number in the display location to zero 333; if the number routine output indicates that the light is green, the control routine increments the display location pointer by one 334 so that the next number can be inputted into the next symbol storage location; also, when the final number has been loaded 335, the control routine shifts the board operation into the play mode by setting the mode flag to zero 336. In the play mode the control routine is triggered by the clear key 337 which causes it to erase all blanking indicator signals 338.

Figure 3D:
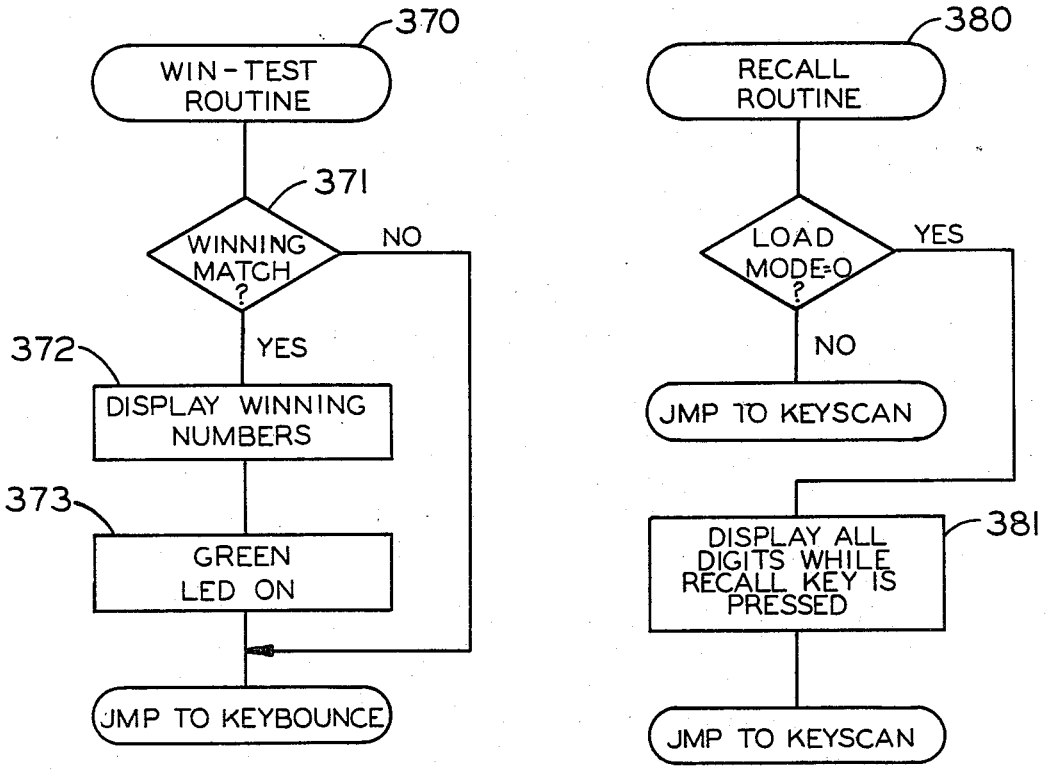

The remaining four routines, the game, blanking, win test and recall routines, only operate during the play mode. The game routine 340 loads the game pattern chosen into the game array pattern storage location 341; then all symbol display locations are turned off except those which form the game pattern 342. The blanking routine 360 in FIG. 3*c* blanks out the number corresponding to the array-symbol switch depressed by the player 361, and causes the program to go to the win test routine. The win test routine 370 shown in FIG. 3*d* compares the array formed by the blanked out numbers with the game pattern to determine if a winning combination exists 371 in which event it displays only the winning numbers 372 and lights the green light 373 which is located at the center of the gaming board 124 in FIG. 1. The recall routine 380 in FIG. 3*d* is activated when the recall key is depressed and temporarily (only so long as the key is depressed) deactivates the blanking signals and displays all the digits 381 so that the player can see the complete numerical array which was loaded.

Figure 4A:
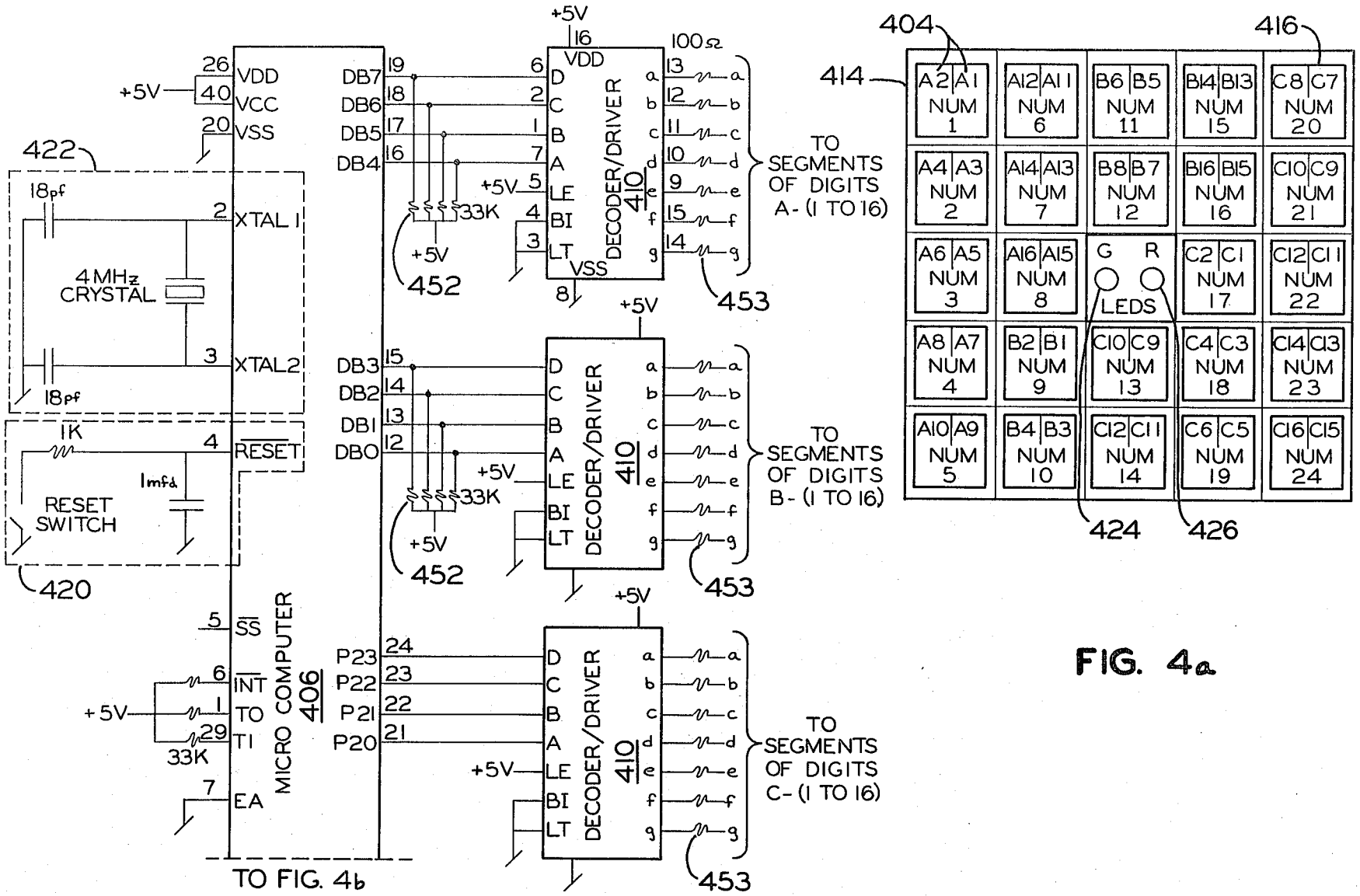
Figure 4B:
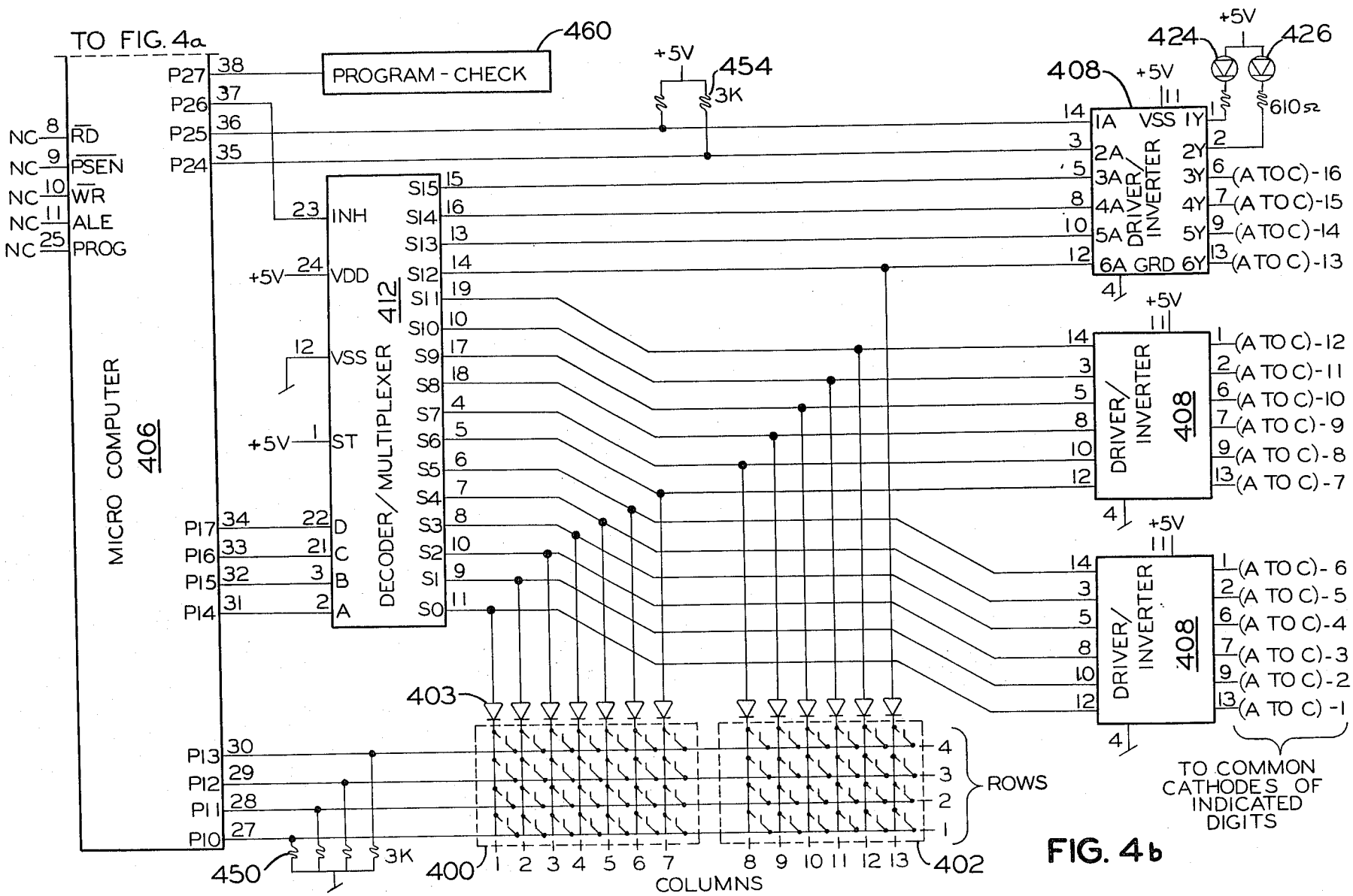

FIGS. 4*a* and 4*b* provide the electrical schematic of a gaming board embodying the present invention. The embodiment depicted comprises seven principal components: a keyboard 400, array-symbol switches 402, seven segment LED digital displays 404, a microcomputer 406, driver/inverters 408, driver/decoders 410, and a decoder/multiplexer 412.

The player inputs information into the gaming board through either a 4×7 cross point keyboard 400 in FIG. 4*b*, containing input and game pattern switches which form a part of the number input part of the game board 110 and the game selection part of the game board 130 as shown in FIG. 1, or through any one of the twenty-four array-symbol switches 42 in FIG. 4b, also shown in FIG. 1 as 122. One array-symbol switch is located by each of the twenty-four number register display locations. Any standard normally open momentary switch, such as a model V42T7 manufactured by Burgess of England, can be used to fulfill the array symbol switch function.

The display part of the board 414 is also generally shown in FIG. 4a and corresponds generally to 120 in FIG. 1. Each of the twenty-four symbol display locations 416 in FIG. 4a comprises two seven segment LED digital displays 404 which in the illustrated embodiment are Hewlett Packard HP 5087-7613 units. The display locations 416 and displays 404 correspond to locations 128 and display means 129 shown in FIG. 1. For purposes of reference, each of the symbol display locations 416 in FIG. 4a and corresponding array-symbol switches not shown in FIG. 4a, but are identified as 122 in FIG. 1, have been identified with a prefix NUM, and the loading order sequence number, e.g. the fourth location, is therefore termed NUM 4. As mentioned earlier, and as shown in FIG. 1, the display is divided into three sections to avoid flickering. The first section 150 is designated as the A section, the second 152 at the B section, and the third 154 as the C section. Within each section the individual LED displays 404 in FIG. 4a are identified in ascending order, being numbered from right to left in a given symbol display location, starting from top to bottom in a given column and then from left to right when changing columns, e.g., the third display in each section is made up of LED displays A6 and A5, B6 and B5 and C6 and C5 reading from left to right and correspond to number register display locations NUM. 3, NUM. 11 and NUM. 19, respectively.

The microcomputer 406 takes the input from the keyboard 400 and array-symbol switches 402, processes it and using the software control program which has been electrically written on a computer chip which forms a part of the computer's nonvolatile memory, generates output control signals which direct the remaining components comprising the gaming board. Another essential part of the microcomputer is its data storage capabilities. The control program sends data to and retrieves data from the computer's data storage locations. Symbols selected by the player and their locations are stored in symbol storage locations. Array-symbols selected by the player and their locations are stored in symbol-array locations. In addition, the game array pattern selected by the player is stored in array pattern storage locations.

The output control signals comprise binary coded high and low voltage signals. The components in turn provide the signals to the LED displays to light the desired segments and digits. The microcomputer 406 used in the present embodiment is an MCS-48 TM microcomputer model number C-8748 manufactured by Intel Corporation of Santa Clara, Calif. The computer 406 is an electrically programmable read only memory microcomputer in a forty pin dual in-line package. Each pin is identified by the number which appears immediately outside the computer 406 adjacent each of the lines emanating from the computer. Adjacent to the pin number on the inside of the computer is the abbreviated functional designation associated with that pin.

The decoder/multiplexer 412 in FIG. 4b is a 4-to-16 line decoder model MC14514B, manufactured by Motorola Semiconductors of Phoenix, Ariz. The decoder/-drivers 410 in FIG. 4a, which convert the binary coded decimal signal outputted by the computer 406 to drive the segments of the LED display, are model MC14511B, also manufactured by Motorola Semiconductors of Phoenix, Ariz. The driver/inverters 408 in FIG. 4b, which provide the necessary interface circuits between the decoder/multiplexer 412 and the LED displays 404 are model SN 75492 manufactured by Texas Instruments.

The power source required to operate the gaming board is a regulated 5 volt power supply; this 5 volt supply is connected to the microcomputer 406, the driver/inverters 408, the decoder/drivers 410, and the decoder/multiplexer 412 as well as to various points in the circuitry to provide pull-up capability for that particular circuit. The embodiment shown of the present invention comprises a 0–5 volt digital system which provides input and output signals of a high and low voltage.

The reset switch circuit 420 in FIG. 4a, which is shown connected to microcomputer 406 pin number 4, reactivates the program and initializes the computer when closed. Access to the switch which closes this circuit may be restricted by mechanical means, such as a key operated lock 142 in FIG. 1, magnetic means such as a magnetic card device or electronic means such as an electronic pulse input key. Once the reset switch has been triggered the board is ready for player input; also, the load time, countdown display 144 in FIG. 1 and the time interrupt routine 350 in FIG. 3c are implemented by the computer and operate using input reference pulses from the timer circuit 422 in FIG. 4a connected to pin numbers 2 and 3 of computer 406.

To load a number, the player depresses a key on the keyboard 400 in FIG. 4b, closing one of the switches. Diodes 403 provide isolation for the multiplexing circuit in the event of multiple key depression. All player input is fed into the computer 406 through pin numbers 27, 28, 29 and 30. Pulldown resistors 450 are included in this circuitry to keep all input signals low until a high signal from a key or switch input occurs. An index of the location of the keys and blanking switches by row and column is programmed into the computer and forms a part of its permanent memory. This information, plus a continuous scanning signal provided by the decoder/multiplexer 412 to the keyboard 400 and array-symbol switches 402, enables the computer to decode the input and determine what key or switch has been depressed. This information is then fed into the program stored in the computer which reflects the routines shown in FIGS. 3a, 3b, 3c and 3d. The program is electrically written on a computer chip's program memory in 8 bit binary code and becomes a permanent part of the computer's memory, as compared to the symbol display information and other player inputted data which are stored in the computer's erasable data storage memory which has the capability of being both written and read.

The decoder/multiplexer 412 in FIG. 4b in addition to providing the continuous scanning signal to the keyboard and array-symbol switches provides the signal to the driver/inverter 408 which in turn provides the necessary power and proper signal to the common cathode of the LED displays. The decoder/multiplexer 412 is a low current device; therefore, since an LED display requires up to on the order of 200 milliamps, the output power needs to be increased. This is the primary function of the driver/inverter 408; it provides the interface circuits necessary to increase the power to the LED displays and, in addition, inverts the signal from the decoder/multiplexer 412 from high to low or low to high, as appropriate. Three driver/inverters are required to provide the necessary signals to the green and red LEDs 424 and 426 in FIGS. 4*a* and 4*b*, which correspond to 124 and 126 in FIG. 1 and to the 16 individual LED displays 404 in FIG. 4*a* in each of the three sections of the display.

The signals for the green 424 and red 426 LED lights in FIG. 4*b* at the center of the game board come directly from the computer 406 from pin numbers 35 and 36 to the driver/inverter 408, and require pull-up resistors 454. The output signal from the driver/inverter 408 passes through a 610Ω resistor to limit the current to the green and red LEDs while maintaining reasonable brightness.

The binary coded decimal signals from the computer for the individual seven segments of the LED display are decoded by the driver/decoders 410 in FIG. 4*a*. The computer output signals emanate from data bus pins numbered 12 through 19; these circuits require pull-up resistors 452 to allow the signal to go low without creating a short in the circuit. The port pins, designated by a P prefix, have the equivalent of a pull-up resistor connected internally, thereby giving them the flexibility of being high or low. The seven output signals each go through a 100Ω resistor 453, whose purpose is to limit the current to the LED segment while at the same time allowing it to maintain reasonable brightness. These outputs connect up to the anodes of the LED displays. Three driver/decoders 410 are required, one for each of the three sections of the display.

Another feature shown generally in FIG. 4*b* is the program-check means 460 connected to pin number 38 of the microcomputer 406. The purpose of the program check operation is to allow the game operator to be assured that the gaming board has been properly obtained by the player for use in that program. Before the gaming board is given to the player, a digital code is inputted into the read and write memory of the computer in a program code storage location. This can be accomplished by insertion of a security key into the board at 146 in FIG. 1 and turning the lock to the input location. This unlocks a switch which provides a signal to the computer that a program code is to be inputted. The control program then causes the computer to address the program code storage location in its read and write memory. The game operator then types in the code for that particular program using the number input part of the gaming board 110 and these numbers are then stored in the computer's memory. Insertion of the security key and turning the lock to the output location will cause the computer to display the program code on the display part of the gaming board 120. When a winning pattern match occurs on the gaming board, the game operator inserts a security key into location 146 and turns the lock to "out," calling up the program code onto the display and thereby can determine if the board was properly obtained.

The circuitry shown in FIGS. 4*a* and 4*b* does not provide for a separate load mode timer display 144, as shown in FIG. 1. The load mode countdown time is instead displayed in the last symbol location NUM.24.

FIG. 5 presents a block diagram of the timing and control components and circuitry for an embodiment of the present invention which utilizes an LCD digital display as the display means. The keyboard and array-symbol switch scanning using a decoder/multiplexer is accomplished in the same manner as described in the LED embodiment. However, because of limitations imposed by the liquid crystal electro-optic response, a different multiplexing scheme than described for the LED embodiment is required. This embodiment incorporates a twisted-nematic field effect LCD which is commonly found in watch and calculator displays. The front and back plane electrodes of the digit segments are configured for a matrix-addressed, $\frac{1}{4}$ multiplexed display, as described in detail in Electronics 51, No. 11, Page 113 (1978). In this scheme, four segment select lines which form the rows of a matrix which form a digit are each connected to the front plane electrodes of two segments on every 8-segment digit. Each digit has two data select lines which form the columns of the digit matrix, each connected to two backplane electrodes which cross under the front plane electrodes of the segment select lines in a matrix fashion.

The signals on the segment select lines are common to all the digits while the two data select lines to each digit determine which segments are on or off. To control 48 digits, which correspond to symbol display means 129 in FIG. 1, requires four segment select lines and 96 data lines. One extra data line is included to provide control for four enunciators, such as an improper-symbol indicator, a proper-symbol indicator, a pattern match indicator and a gaming board battery low voltage indicator. This makes a total of 97 data select lines. Therefore, 97 data select lines and four segment select lines are required to provide the input signals to the display 500. Because the LCD requires voltage levels that differ from the digital output signals, the signals interface to the LCD through analog switches 501, which turn on and off the proper voltages to the LCD while under digital control. The four segment select lines that go to all the digits require a repetitive signal for proper timing and sequencing; this is supplied by a binary counter 502. The microcomputer 510 provides a time pulse to as well as the control program for operation of the binary counter. The microcomputer 510 requires the same capabilities as shown for microcomputer 206 in FIG. 2. An example of a microcomputer which is compatible with the LCD embodiment is the Model 87C48, manufactured by Intersel of Santa Clara, Calf. The data select lines that determine which segments are on and off require eight bits of data per digit, or four bits per data select line. This information for the 97 data lines is stored in a 97×4 bit read and write memory 503 which is separate from the computer 510 in this embodiment but need not be. The binary counter 502 sequentially addresses each of the 97 data select line information locations in the read/write memory 503 through seven binary address lines, which are also input to and monitored by the microcomputer 510. For each address the read/write memory 503 outputs four bits of data. The binary counter 502 also provides the proper timing and sequencing to the multiplexer 504 which then allows the appropriate bit of data for each sequence through memory to pass to the shift register 505. Once the shift register is filled, the control logic 507, which utilizes timing and sequencing information from the binary counter 502, latches the outputs to 97 parallel output lines which provide digital signals to analog switches 506 which drive the data select lines for the LCD display 500. The above display circuitry does not require continuous microcomputer control, however, the computer 510 makes changes in the display by monitoring the addresses from the binary counter 502 to the read/write memory 503, and when the location that is to be changed is addressed, the computer 510 stops the binary counter 502, switches the read/write memory 503 from read to write, and loads new data into that memory location through the four data lines.

Various embodiments other than those shown and described herein will become apparent to those skilled in the art from the foregoing description and accompanying drawings. Such other embodiments and modifications, equivalents, and alternates thereof are intended to fall within the scope of the appended claims.

Various features of the invention are set forth in the following claims.

What is claimed is:

1. A chance based gaming board comprising:

display means including means for visually displaying a plurality of symbols in a predetermined array of symbol display locations;

computer means including a control program stored in a nonvolatile read only memory means, data processor means controlled by said control program, data storage means including a plurality of symbol storage locations, said storage locations storing a single game board and means for generating and outputting one or more control signals;

input switch means for enabling the manual selection of one of a plurality of symbols;

array-symbol switch means including a plurality of actuatable array-symbol switches, each switch positioned adjacent a respective one of said symbol display locations for enabling the manual selection of one of said symbols in said array of symbol display locations;

means for selecting a first game mode, said processor means and control program acting in response thereto to generate control signals such that the present state of said input switch means is periodically sensed, to cause said data storage means to store said sensed symbols in a selected sequence in said symbol storage locations, and to generate control signals such that said display means is caused to display said sensed symbols in corresponding symbol display locations; and means for selecting a second game mode, said processor means and control programs acting in response thereto to generate control signals such that each actuation of an array-symbol switch means is sensed to cause the identity of said sensed switch to be stored in said data storage means and to generate one or more control signals such that said display means is caused to indicate that the sensed array-symbol switch corresponding to the symbol display location has been selected and to further visually display the stored array-symbol switch states in a manner which differs from the manner in which the non-selected array-symbol switch symbol display locations are displayed.

2. A gaming board as defined in claim 1 which further comprises improper-symbol identification means which forms a part of the control program and for precluding the storage of improper symbols in said storage location means.

3. A gaming board as defined in claim 2 where said improper-symbol identification means further comprises a control program which prevents duplicate symbols from being stored in said storage locations.

4. A gaming board as defined in claim 1 which further comprises timing means for limiting the length of time of said first game mode which includes shut-off means for deactivating said input switch means; and where said processor means and control program acting in response to said means for selecting said first game mode generate one or more control signals such that the present state of said timing means is periodically sensed to cause said shut-off means to deactivate said input switches when the length of time allocated for said first game mode has expired.

5. A gaming board as defined jn claim 4 where said shut-off means further comprise a switch means which reactivates and initializes said timing means.

6. A gaming board as defined in claim 1 which further comprises a program-check means under the control of said control program and data processor for displaying a program code which comprises a code storage means and code display switch means wherein switch means enable the selection of the code which comprises a combination of symbols, said code being stored in said code storage means and being displayed in response to activation of said code display switch means in designated symbol display locations.

7. A chance based gaming board comprising:

display means including means for visually displaying a plurality of symbols in a predetermined array of symbol display locations;

computer means including a control program stored in a nonvolatile read only memory means, data processor means controlled by said control program, data storage means including a plurality of symbol storage locations said storage locations storing a single game board and means for generating and outputting one or more control signals;

means for storing a predetermined array pattern;

input switch means for enabling the manual selection of one of a plurality of symbols;

array-symbol switch means including a plurality of actuatable array-symbol switches, each switch positioned adjacent a respective one of said symbol display locations for enabling the manual selection of one of said symbols in said array of symbol display locations;

means for visually indicating a pattern match;

means for selecting a first game mode, said processor means and control program acting in response thereto to generate control signals such that the present state of said input switch means is periodically sensed, to cause said data storage means to store said sensed symbols in a selected sequence in said symbol storage locations, and to generate control signals such that said display means is caused to display said sensed symbols in corresponding symbol display locations; and means for selecting a second game mode, said processor means and control program acting in response thereto to generate control signals such that each actuation of an array-symbol switch means is sensed to cause the identity of said sensed switch to be stored in said data storage means to compare said stored array-symbol switch states with said predetermined pattern and to generate one or more control signals to actuate said pattern match indicating means if such match is detected.

8. A gaming board as defined in claim 7 which further comprises means for visually distinguishing said predetermined array pattern from said predetermined array of symbol display locations.

9. A gaming board as defined in claim 7 which further comprises timing means for limiting the length of time of said first game mode which includes shut-off means for deactivating said input switch means; and where said processor means and control program acting in response to said means for selecting said first game mode generate one or more control signals such that the present state of said timing means is periodically sensed to cause said shut-off means to deactivate said input switches when the length of time allocated for said first game mode has expired.

10. A gaming board as defined in claim 9 where said shut-off means further comprise a switch means which reactivates and initializes said timing means.

11. A gaming board as defined in claim 7 which further comprises improper-symbol identification means which forms a part of the control program and for precluding the storage of improper symbols in said storage location means.

12. A chance based gaming board comprising:

display means including means for visually displaying a plurality of symbols in a predetermined array of symbol display locations, where said predetermined array comprises the shape of a square with the centermost location not containing a symbol;

computer means including a control program stored in a nonvolatile read only memory means, said control program further comprising an improper-symbol identification means, data processor means controlled by said control program data storage means including a plurality of symbol storage locations said storage locations storing a single game board and means for generating and outputting one or more control signals;

means for storing a predetermined array pattern;

input switch means for enabling the manual selection of one of a plurality of symbols;

array-symbol switch means including a plurality of actuatable array-symbol switches, each switch positioned adjacent a respective one of said symbol display locations for enabling the manual selection of one of said symbols in said array of symbol display locations;

means for visually indicating a pattern match;

timing means for limiting the length of time of a game mode for said selection of symbols which includes shut-off means for deactivating said input switch means, said shut-off means further comprises a switch means which reactivates and initializes said timing means;

means for selecting a first game mode, said processor means and control program acting in response thereto to generate control signals such that the present state of said timing means and said input switch means is periodically sensed, to cause said data storage means to store said sensed symbols in a selected sequence in said symbol storage locations, and to generate control signals such that said display means is caused to display said sensed symbols in corresponding symbol display locations and to cause said shut-off means to deactivate said input switches when the length of time allocated for said first game mode has expired; and means for selecting a second game mode, said processor means and control programs acting in response thereto, thereby generating control signals such that each actuation of an array-symbol switch means is sensed to cause the identity of said sensed switch to be stored in said data storage means and to generate one or more control signals such that said display means is caused to indicate that the sensed switch corresponding to the symbol display location has been selected and to further visually display the stored array switch states in a manner which differs from the manner in which the nonselected array switch symbol display locations are displayed, and further to compare said stored array-symbol switch states with said predetermined pattern and to generate one or more control signals to actuate said pattern match indicating means if such match is detected.

13. A gaming board as defined in claim 12 which further comprises means for visually distinguishing said predetermined array pattern from said predetermined array of symbol display locations.

* * * * *